US007207167B2

(12) United States Patent
Kim

(10) Patent No.: US 7,207,167 B2
(45) Date of Patent: Apr. 24, 2007

(54) MANUFACTURING PROCESS OF NON-TWISTED YARN

(76) Inventor: Kwan-Young Kim, 9-106 Samjung Heights, Doma 1-dong, Seo-Ku, Daejeon-city (302-161) (KR)

( * ) Notice: Subject to any disclaimer, the term of this patent is extended or adjusted under 35 U.S.C. 154(b) by 0 days.

(21) Appl. No.: 10/507,654

(22) PCT Filed: Mar. 14, 2003

(86) PCT No.: PCT/KR03/00504

§ 371 (c)(1),
(2), (4) Date: Sep. 10, 2004

(87) PCT Pub. No.: WO03/078709

PCT Pub. Date: Sep. 25, 2003

(65) Prior Publication Data

US 2005/0132692 A1 Jun. 23, 2005

(30) Foreign Application Priority Data

Mar. 18, 2002 (KR) ..... 10-2002-0014563

(51) Int. Cl.
*D07B 7/18* (2006.01)

(52) U.S. Cl. ..... 57/2.3

(58) Field of Classification Search ..... 57/2.3, 57/2.5

See application file for complete search history.

(56) References Cited

U.S. PATENT DOCUMENTS

| | | | | |
|---|---|---|---|---|
| 2,715,753 | A * | 8/1955 | McLellan | 425/319 |
| 2,801,455 | A * | 8/1957 | McLellan | 57/2.3 |
| 3,456,431 | A * | 7/1969 | Fleissner | 57/295 |
| 3,866,403 | A * | 2/1975 | Zimmermann, Jr. | 57/1 UN |
| 4,007,580 | A | 2/1977 | Nijhuis | 57/140 BY |
| 4,051,658 | A | 10/1977 | Terwee et al. | 57/140 BY |
| 4,107,914 | A | 8/1978 | Van Dort | 57/164 |

FOREIGN PATENT DOCUMENTS

| | | |
|---|---|---|
| JP | 59-82437 | 5/1984 |
| JP | 2001192940 A | 7/2001 |
| KR | 1986-0003370 | 5/1986 |
| KR | 1997-0062870 | 9/1997 |
| KR | 144692 | 4/1998 |

OTHER PUBLICATIONS

Hatch, Textile Science, 1993, West Publishing Company, 1st edition, p. 404.*

International Search Report in PCT/KR03/00504 dated Jun. 30, 2003.

* cited by examiner

*Primary Examiner*—Shaun R. Hurley
(74) *Attorney, Agent, or Firm*—Marshall, Gerstein & Borun LLP

(57) ABSTRACT

A manufacturing process of untwisted yarn. Spun yarn is sized and hit during drying. The yarn is untwisted by being twisted in a reverse direction opposite to the spin direction, and/or further twisted in the reverse direction, to develop a high tensile strength and flexibility.

11 Claims, 2 Drawing Sheets

MANUFACTURING PROCESS OF NON-TWISTED YARN

BACKGROUND OF THE INVENTION (a) Field of the Invention

The present invention relates to a manufacturing process for untwisted (i.e., non-twisted) yarn, and more particularly, to a manufacturing process for untwisted yarn that is very soft to the touch and is capable of insulating well.

(b) Description of the Related Art

Untwisted yarn is the general term for yarn having an untwisted ratio ranging from 70% to 100% and having a very soft, bulky feeling, and that is capable of insulating and being absorbent, so that it may be adapted for making towels, bath gowns, and cotton fabrics for babies, etc.

A conventional manufacturing process of untwisted yarn has been proposed in Korean Patent No. 144692, entitled "Untwisted yarn and manufacturing process of untwisted fabric using such." In the conventional process, soluble yarn and insoluble twisted yarn is twined, and then untwisted in a reverse direction. Next, the soluble yarn is dissolved, thereby resulting in untwisted yarn.

However, the conventional process has some drawbacks, as follows.

First, since soluble yarn contracts differently from insoluble twisted yarn, the insoluble yarn may bunch together on one side, resulting in poor characteristics when weaving.

Second, after the untwisting process, the insoluble yarn spirally winds around the soluble yarn. Accordingly, the resultant yarn may endure severe resistance of rubbing in a heald and a reed when weaving. Further, since the yarn is supported by tension of the soluble yarn, it is not adapted for a warp.

Third, when polyester yarn is used as the soluble yarn, it should be immersed and dissolved in an alkali solution that may be fatal to human bodies and may cause environmental pollution as well as high treatment costs. Further, it takes a considerably long time to dissolve the soluble yarn in the alkali solution.

SUMMARY OF THE INVENTION

In view of the prior art described above, it is an object of the present invention to provide an improved manufacturing process for untwisted yarn having good tensile strength and flexibility, without any soluble yarn.

It is another object of the present invention to provide a manufacturing process for untwisted yarn that is adapted for a warp as well as a weft, and that facilitates weaving of fabrics and knits.

To achieve the above and other objects, as embodied and broadly described herein, the invention comprises the steps of:

sizing spun yarn; and untwisting the spun yarn by twisting it in a reverse direction that is opposite to the original spin direction.

The reverse-twisting step is preferably performed by applying a reverse twist to the spun yarn by further twisting it beyond the untwisted state in the reverse direction.

The process may further include the step of applying steam to the yarn in order to facilitate the penetration of size, before the sizing step. The yarn dries out by 80–90% after the sizing step, and is then hit by a hitting roller in order to make it even.

DETAILED DESCRIPTION OF THE PREFERRED EMBODIMENTS

The present invention will be described in detail with reference to the accompanying drawings.

A. STEAMING PROCESS

Figure 1:
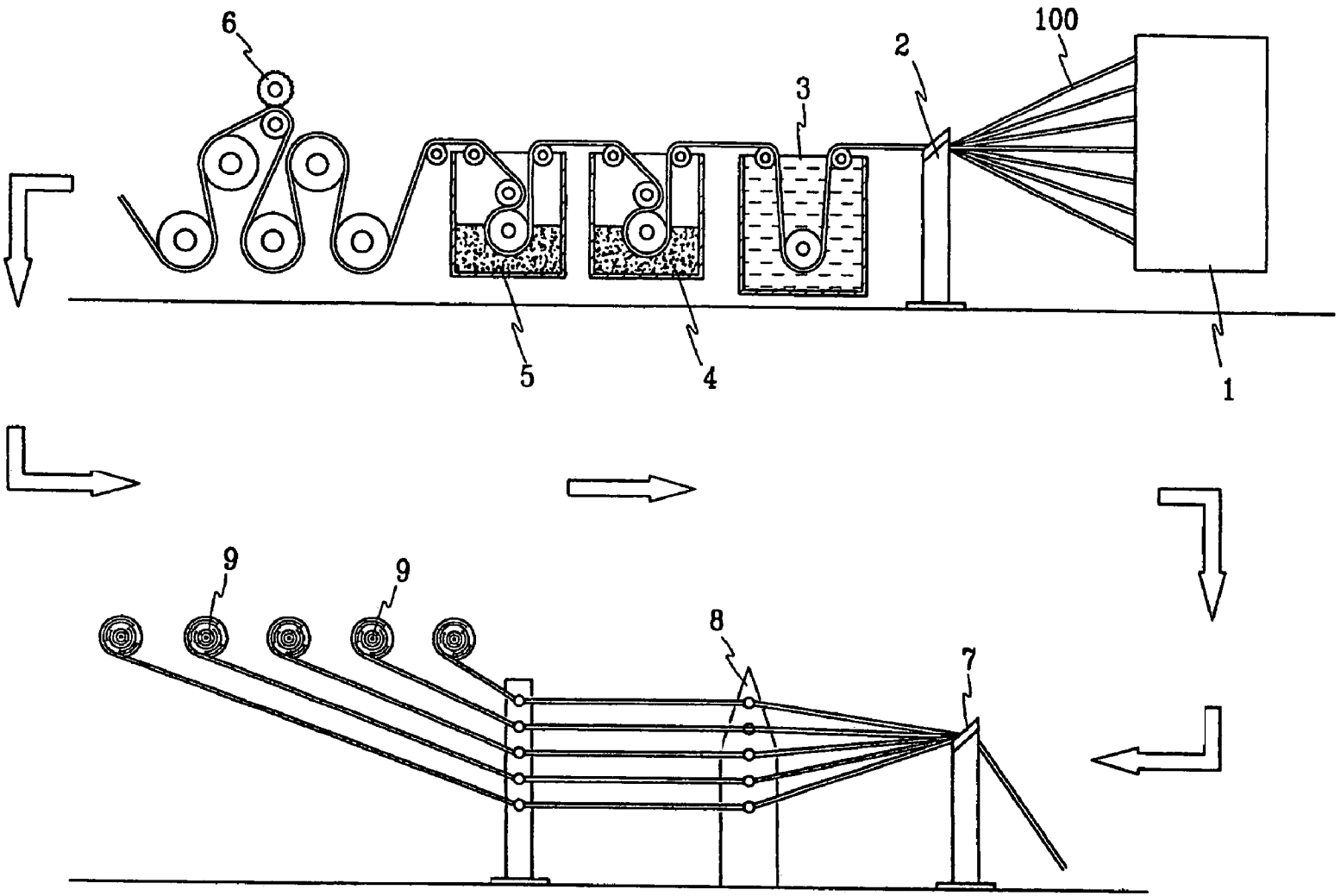
FIG. 1 shows a schematic view illustrating the sizing process according to the present invention.

Referring first to FIG. 1, spun yarn 100, such as cotton or wool short staple yarn is provided to a steaming machine 3 through a creel 1 and reed 2.

The steaming machine 3 has an inner space in which steam is provided. The spun yarn from the reed 2 passes through the inner space of the steaming machine 3 to absorb some moisture, because size tends to penetrate the spun yarn better when it contains moisture than when it is completely dried out.

B. SIZING PROCESS

In the sizing process, the spun yarn is sized to an appropriate extent by first and second sizing machines 4, 5 of FIG. 1. The first and second sizing machines 4, 5 are general tanks having inner spaces containing the size, and as the yarn passes though the inner spaces it is penetrated by the size. It is preferable to use a soft and strongly adhesive size in the sizing process.

C. HITTING PROCESS

After the sizing process, the yarn in which the size is penetrated dries out. When the yarn dries by about 80–90%, a hitting roller 6 as shown in FIG. 1 strikes and impresses the yarn in a direction opposite to the twisting direction in order to enhance the adhesive property and tensile strength.

Figure 2:
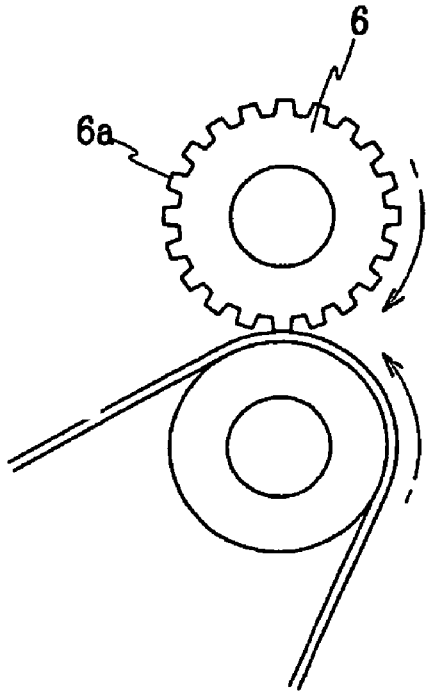
FIG. 2 shows an enlarged view of a hitting roller according to the present invention.
Figure 3:
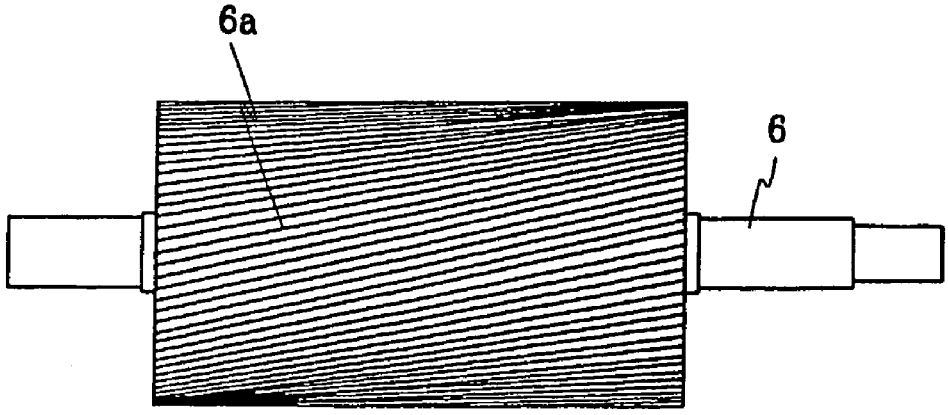
FIG. 3 shows a plane view of the hitting roller of FIG. 2.

The hitting roller 6 as shown in FIGS. 2 and 3 has a shape of a general roller with teeth 6*a* that spirally protrude at an interval of about 0.5–1 mm at the outer periphery of the roller. The teeth 6*a* of the hitting roller 6 are formed in a direction opposite that of the twists of the yarn, to hit the yarn evenly and effectively.

After the yarn is hit by the hitting roller, it dries out completely to be a sized yarn. The yarn is then led through the reed 7 to a distributor 8, and is distributed to each winding spindle 9.

D. UNTWISTING PROCESS

The sized yarn wound around the winding spindle 9 is then untwisted by twisting it in a reverse direction that is opposite to the original spin direction.

For example, the untwisting process is performed such that Z-twisted 843.4 TPM spun yarn is untwisted into S-twisted 590 TPM to 840 TPM yarn, thereby having an untwisted ratio ranging from 70% to 100%.

E. REVERSE-TWISTING PROCESS

Next, the yarn is further twisted in the reverse direction. That is, the yarn is completely untwisted and further twisted in the reverse direction.

For example, the reverse-twisting process is performed such that a Z-twisted 843.4 TPM spun yarn is twisted in the reverse direction until it becomes S-twisted 925 TPM–1096 TPM in the untwisting and reverse-twisting steps, such that the yarn is reverse-twisted by 10–30% beyond the completely untwisted state to have a resultant 70–90% untwisted ratio.

The untwisted yarn manufactured as in the above process may be weaved as knits or fabrics without any additional removing process of the soluble yarn. The size is generally removed in a scouring process when dyeing so that knits or fabrics may be finished and ready for manufacture.

Table 1 show the tensile strength of the untwisted yarn according to the present invention, measured at each process.

TABLE 1

Base spun yarn: No. 30 count combed cotton yarn, made in India
Twisting direction (KS K 0413): Z-twisted,
Twisting number (KS K 0417): TPM 843.4

| No. | Status | tensile strength of yarn (KS K 0409-2001, C, R, E): gf |
|---|---|---|
| 1 | base spun yarn | 232 |
| 2 | Sized spun yarn after sizing process | 478 |
| 3 | Spun yarn after untwisting process: S-twisted 590 TPM sized yarn (70% untwisted) | 229 |
| 4 | Spun yarn after untwisting process: S-twisted 840 TPM sized yarn (100% untwisted) | 257 |
| 5 | Spun yarn after reverse-twisting process: S-twisted 1095 TPM sized yarn (30% reverse-twisted) | 293 |

According to Table 1, No. 30 count combed cotton yarn (#1) is about Z-twisted 840 TPM and has a tensile strength of 232 gf. The sized yarn (#2) after the sizing process has a tensile strength of 478 gf. The sized yarn is untwisted or reverse-twisted under several different conditions, as follows.

First, the sized yarn (#2) is untwisted into an S-twisted 590 TPM yarn to have an untwisted ratio of 100%. The tensile strength is measured at about 229 gf at an untwisted ratio of 70% and 257 gf at an untwisted ratio of 100%, respectively. The sized and untwisted yarns have tensile strengths that are −3 and +24 of the al spun yarn, respectively.

Second, the sized yarn (#2) is twisted in the reverse direction into an S-twisted 1095 TPM yarn to be a reverse-twisted yarn of a 30% ratio, thereby resulting in an untwisted yarn with an untwisted ratio of 70%. However, the reverse-twisted yarn has a tensile strength of 293 gf, which is greater than that of mere untwisted yarn.

The above specific measurement was performed by the FITI Testing & Research Institute of Korea by request of the inventor. Further, when a yarn that has a greater tensile strength is needed for manufacturing special fabrics, the yarn may pass through a steaming process that enhances the penetration of the size, and/or a hitting process that enhances the mutual adhesive property, It is noted that the untwisted yarn according to the present invention has improved tensile strength as well as enhanced flexibility. The yarn is used not only as the weft, but also as the warp in various applications.

It will be apparent to those skilled in the art that various modifications and variations can be made to the process of the present invention without departing from the spirit and scope of the invention. The present invention covers the modifications and variations of this invention provided they come within the scope of the appended claims and their equivalents.

What is claimed is:

1. A process for manufacturing non-twisted yarn using spun yarn having twists in a spin direction, comprising the steps of:

sizing the spun yarn; and untwisting the spun yarn by twisting it in a reverse direction that is opposite to the spin direction, thereby providing non-twisted yarn having a tensile strength which is greater than that of the spun yarns, wherein the untwisting step is performed by untwisting a Z-twisted 843.4 TPM spun yarn into S-twisted 590 to 840 TPM yarn to impact an untwisted ratio ranging from about 70% to 100%.

2. A process as recited in claim 1, further comprising the step of:

applying a reverse twist to the spun yarn by further twisting it in the reverse direction thereby causing further twists in the reverse direction.

3. A process as recited in claim 2, wherein the Z-twisted 843.4 TPM spun yarn becomes S-twisted 925 TPM–1096 TPM yarn in the untwisting and reverse-twisting steps, by twisting a further 10–30% beyond a completely untwisted state, thereby resulting in a 70%–90% untwisted ratio.

4. A process as recited in claim 1, further comprising the step of:

applying steam to the yarn in order to facilitate the penetration of size, before the sizing step.

5. A process as recited in claim 1, further comprising the step of:

hitting the yarn with a hitting roller between the sizing step and the untwisting step.

6. A process as recited in claim 5, comprising drying the yarn by 80–90% after the sizing step, and then passing the yarn through the hitting step.

7. A process as recited in claim 5, wherein the hitting roller has teeth that are formed spirally.

8. A process as recited in claim 2, further comprising the step of:

applying steam to the yarn in order to facilitate the penetration of size, before the sizing step.

9. A process as recited in claim 2, further comprising the step of:

hitting the yarn with a hitting roller between the sizing step and the untwisting step.

10. A process as recited in claim 9, comprising drying the yarn by 80–90% after the sizing step, and then passing the yarn through the hitting step.

11. A process as recited in claim 9, wherein the hitting roller has teeth that are formed spirally.

* * * * *